US011223161B2

(12) United States Patent
Qiu et al.

(10) Patent No.: US 11,223,161 B2
(45) Date of Patent: Jan. 11, 2022

(54) ELECTRIC CONNECTOR WITH CONNECTOR POSITION ASSURANCE

(71) Applicant: Lear Corporation, Southfield, MI (US)

(72) Inventors: Shi Qing Qiu, Shanghai (CN); Xiaopeng Yu, Shanghai (CN)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 16/983,400

(22) Filed: Aug. 3, 2020

(65) Prior Publication Data

US 2021/0083426 A1 Mar. 18, 2021

(30) Foreign Application Priority Data

Sep. 16, 2019 (CN) ..... 201910873036.3

(51) Int. Cl.
*H01R 13/62* (2006.01)
*H01R 13/629* (2006.01)

(52) U.S. Cl.
CPC . *H01R 13/62927* (2013.01); *H01R 13/62955* (2013.01)

(58) Field of Classification Search
CPC ..... H01R 13/62927; H01R 13/62955; H01R 13/6295
See application file for complete search history.

(56) References Cited

U.S. PATENT DOCUMENTS 9,281,614 B1 3/2016 Bonucci et al.
2019/0123485 A1* 4/2019 Probert ..... H01R 13/62966

FOREIGN PATENT DOCUMENTS

EP 2735061 B1 3/2017

* cited by examiner

*Primary Examiner* — Ross N Gushi
(74) *Attorney, Agent, or Firm* — MacMillan, Sobanski & Todd, LLC

(57) ABSTRACT

An electric connector assembly includes a housing and an assist lever is attached to the housing for relative rotational movement. The electric connector assembly includes a latch that retains the assist lever in a final position relative to the housing. The electric connector assembly also includes a connector position assurance that is attached to the housing for relative movement between a pre-lock position and a lock position. When the connector position assurance is in the lock position, it extends into a notch in the assist lever and prevents rotation of the assist lever relative to the housing.

17 Claims, 7 Drawing Sheets

ELECTRIC CONNECTOR WITH CONNECTOR POSITION ASSURANCE

BACKGROUND OF THE INVENTION

This invention relates to an electric connector. More specifically, this invention relates to a lever-assisted electric connector with a connector position assurance.

An electric connector is typically used to hold multiple electric terminals in selected positions. The electric connector can be mated with a corresponding connector in order to mate each of the electric terminals with its corresponding terminal. This allows an operator to make multiple electric connections at once by plugging the electric connector into the corresponding connector.

Conventional vehicles include an increasing number of electric components which, in turn, call for an increasing number of electric connections. As a result, electric connectors in conventional vehicles include an increasing number of electric terminals. This increased number of terminals increases the amount of force that must be used in order to mate the electric connector with the corresponding connector. In order to make it easier for the operator to mate the connectors, it is known to provide electric connector with an assist lever, such as shown in U.S. Pat. No. 9,281,614, to provide the operator with a mechanical advantage when mating the connectors.

It is also known to provide a connector position assurance so that the operator is able to ensure that the electric connector is properly mated with the corresponding connector. The connector position assurance is typically attached to either the electric connector or the corresponding connector and is initially held in place by a lock. When the electric connector is mated with the corresponding connector, the lock is released so that the connector position assurance can be moved. The connector position assurance can be moved to a final position when the electric connector is properly mated with the corresponding connector. However, if the two connectors are not completely mated, then the connector position assurance is blocked from moving to the final position. When the operator mates the connectors and moves the connector position assurance to the final position, it is confirmed that the connectors and all the electric terminals are properly mated. It would be advantageous to have an improved electric connector with a connector position assurance.

SUMMARY OF THE INVENTION

This invention relates to an electric connector assembly. The electric connector assembly includes a housing. An assist lever is attached to the housing for relative rotational movement. The electric connector assembly includes a latch. The latch retains the assist lever in a final position relative to the housing. The electric connector assembly also includes a connector position assurance. The connector position assurance is attached to the housing for relative movement between a pre-lock position and a lock position. When the connector position assurance is in the lock position, it extends into a notch in the assist lever and prevents rotation of the assist lever relative to the housing.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
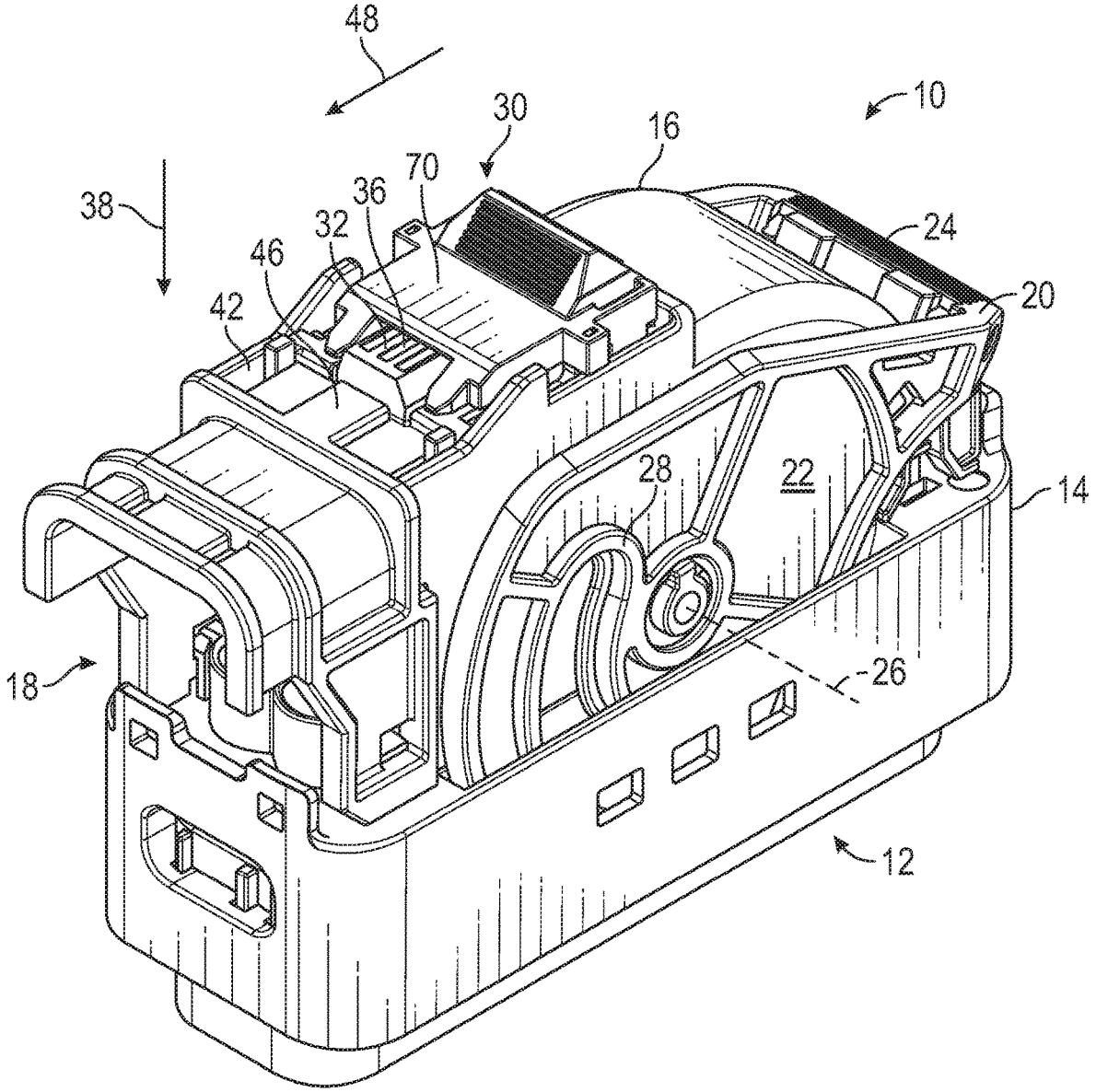
FIG. 1 is a perspective view of an electric connector assembly and a header shown in a pre-mated position.

Referring now to the drawings, there is illustrated in FIG. 1 a perspective view of an electric connector assembly, indicated generally at 10, and a header, indicated generally at 12. The electric connector assembly 10 is shown in a pre-mate position relative to the header 12. The electric connector assembly 10 includes a housing 14 and a cover 16 attached to the housing 14. The cover 16 acts as a wire guide and includes a wire outlet, indicated generally at 18, that is adapted to route wires (not shown) connected to terminals (not shown) held in the housing 14. The electric connector assembly 10 also includes an assist lever 20 that is shown in an initial position.

Figure 2:
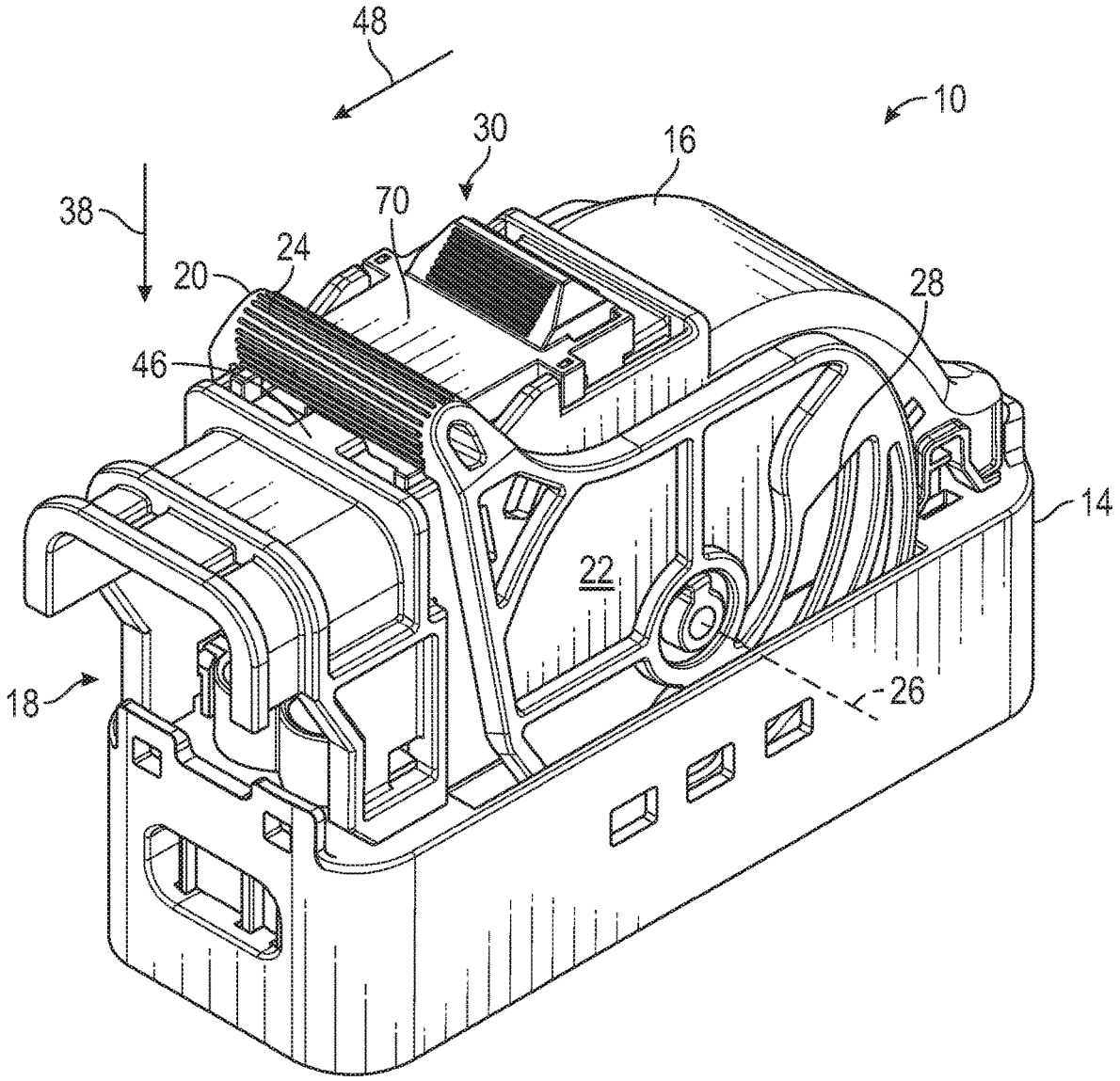
FIG. 2 is a view similar to FIG. 1 showing the electric connector assembly and the header shown in a mate position.

The assist lever 20 includes two plates 22 that are connected by a handle 24. Each of the plates 22 is supported on the cover 16 for relative rotation about a handle axis 26. Each of the plates 22 includes a cam channel 28 (one is visible in FIG. 1) that is adapted to accommodate a respective cam follower (not shown) on the header 12. The assist lever 20 is adapted to be moved from the initial position, shown in FIG. 1, to a final position, shown in FIG. 2. When the assist lever 20 is moved from the initial position to the final position, the electric connector assembly 10 is moved from the pre-mate position to a mate position. In the mate position, the terminals in the electric connector assembly 10 are mated with respective corresponding electric terminals (not shown) in the header 12.

The electric connector assembly 10 also includes a connector position assurance, indicated generally at 30. The illustrated connector position assurance 30 is attached to the cover 16, but may be attached to any desired part of the electric connector assembly 10. The connector position assurance 30 is movable relative to the cover 16 between a pre-lock position (shown in FIG. 1) and a lock position (shown in FIG. 2). As will be described below, the connector position assurance 30 is locked in the pre-lock position and is released from the pre-lock position when the assist lever 20 is moved to the final position. Further, the connector position assurance 30 engages the assist lever 20 to retain the assist lever 20 in the final position.

The electric connector assembly 10 includes a latch 32 that retains the assist lever 20 in the final position. The latch 32 includes a cantilevered arm 34 that includes a press end 36. The latch 32 is normally in a closed position. When a force is applied to the press end 36 in a release direction 38 (shown in FIG. 1), the latch 32 is deflected to an opened position. In the illustrated embodiment, the release direction 38 is toward the header 12, but may be any desired direction.

When the assist lever 20 is moved from the initial position to the final position, the assist lever 20 engages the press end 36 of the latch 32 and pushes it in the release direction 38 to the opened position. This allows the assist lever 20 to be moved past the latch 32. In the illustrated embodiment, the handle 24 of the assist lever 20 engages the latch 32, but any desired part of the assist lever 20 may engage the latch 32. When the assist lever 20 is moved to the final position, the latch 32 rebounds to the closed position, and engages the assist lever 20 to prevent the assist lever 20 from being moved from the final position.

Figure 3:
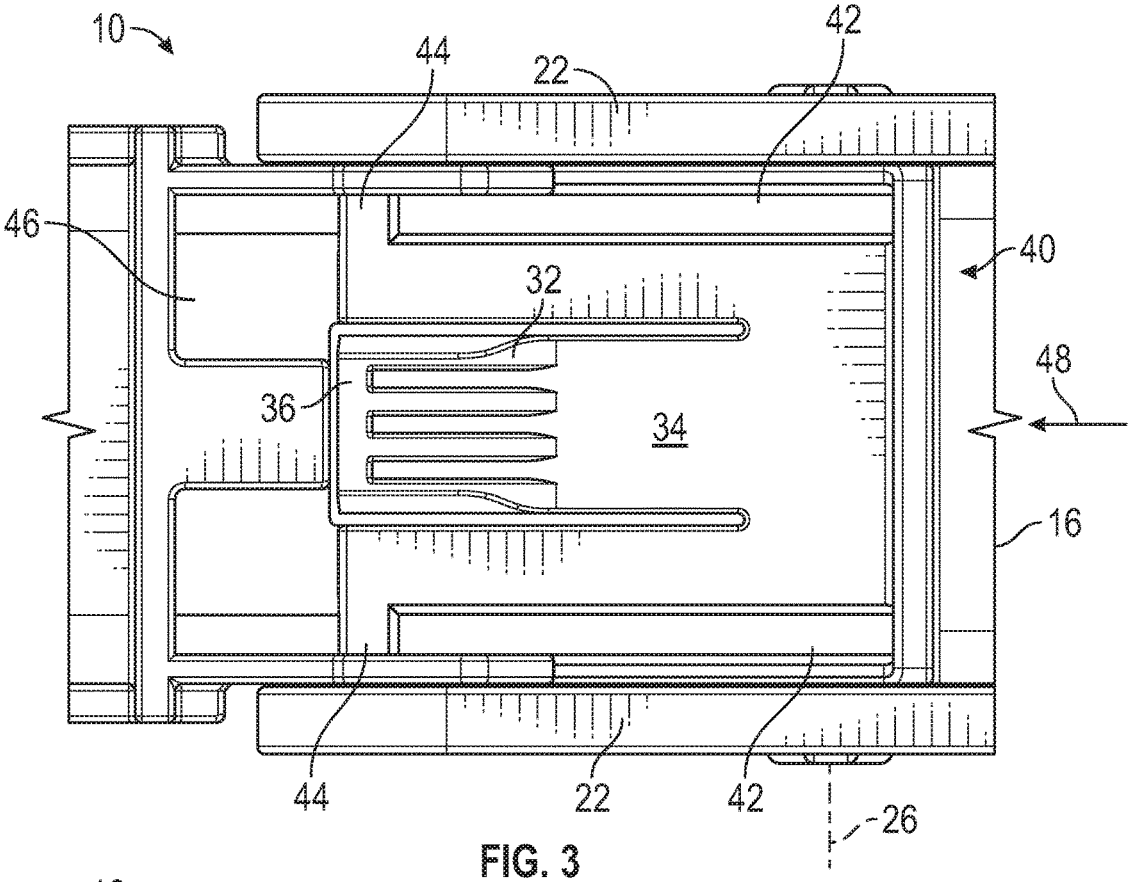
FIG. 3 is an enlarged, top plan view of a portion of the electric connector assembly from FIG. 1 showing a cover and an assist handle attached to the cover in an initial position.

Referring to FIG. 3, there is illustrated an enlarged, top plan view of a portion of the electric connector assembly 10 showing a portion of the cover 16 and the attached assist lever 20 in the initial position. The electric connector assembly 10 includes a connector position assurance mount, indicated generally at 40. The connector position assurance mount 40 is defined in the cover 16 and supports the connector position assurance 30 in the pre-lock position and the lock position. The connector position assurance mount 40 includes two guide channels 42 located on opposed sides of the connector position assurance mount 40. The latch 32 is located within the connector position assurance mount 40 and between the guide channels 42 located on opposed sides of the latch 32. Each of the illustrated guide channels 42 is longer than the cantilevered arm 34 and the press end 36 of the latch 32, but the guide channels 42 may have any desired length. Each of the guide channels 42 includes a position assurance lock 44 that extends across the respective guide channel 42. The purpose of the position assurance locks 44 will be described below.

The cover 16 also includes an optional handle seat 46. When the assist lever 20 is in the final position, a portion of the handle 24 is located in the handle seat 46. The handle seat 46 is located in an assurance direction 48 from the latch 32, and each of the guide channels 42 extends into the handle seat 46.

Figure 4:
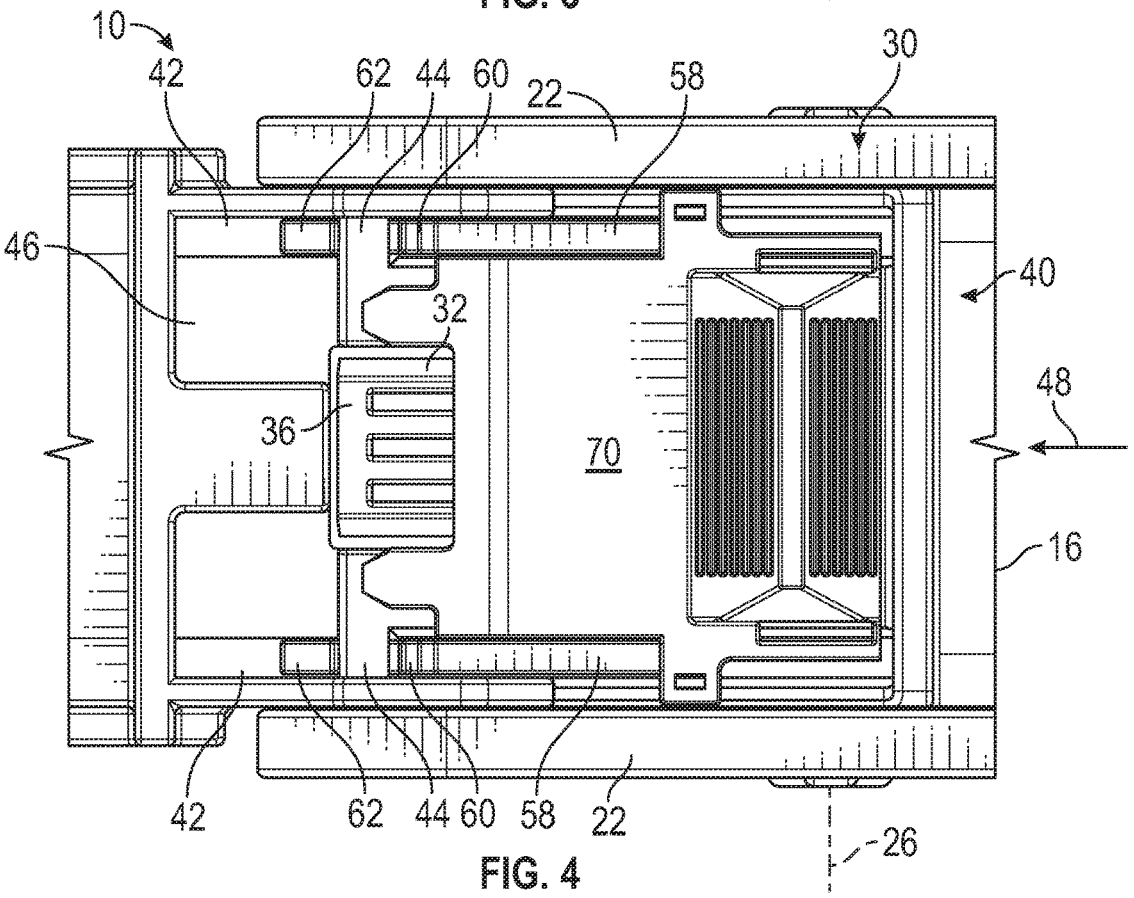
FIG. 4 is a view similar to FIG. 3 showing a connector position assurance attached to the cover in a pre-lock position.
Figure 5:
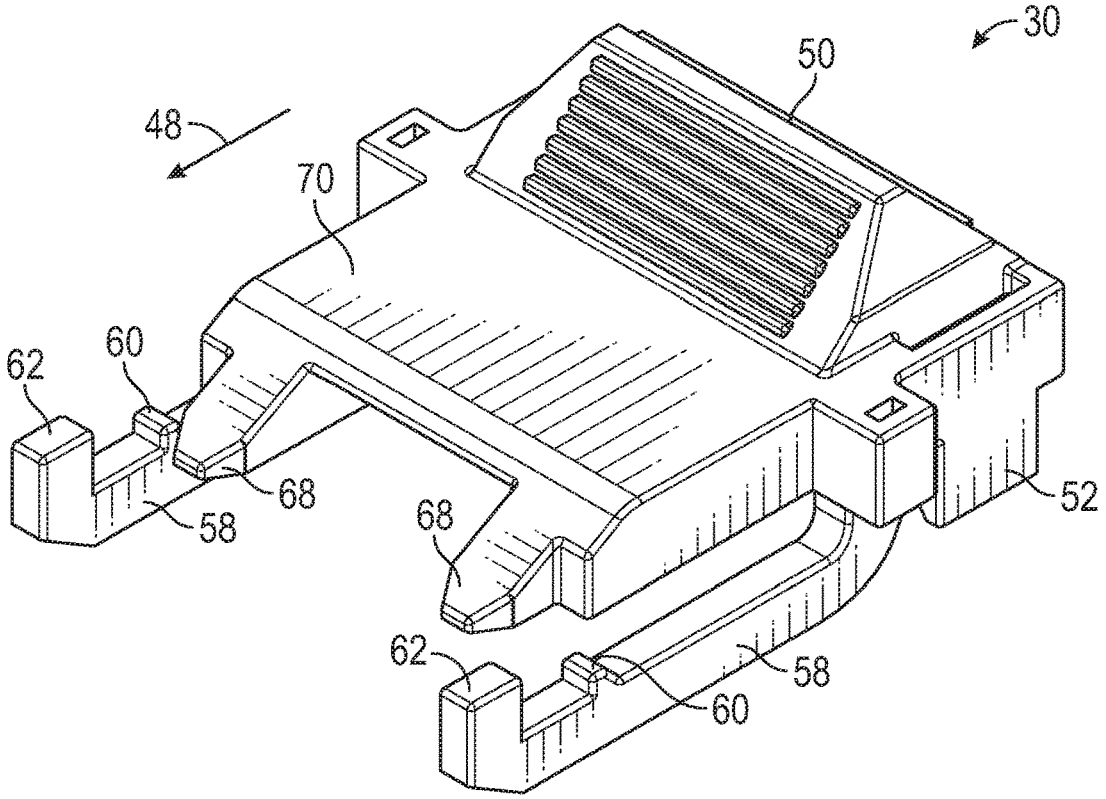
FIG. 5 is a perspective view of the connector position assurance.
Figure 6:
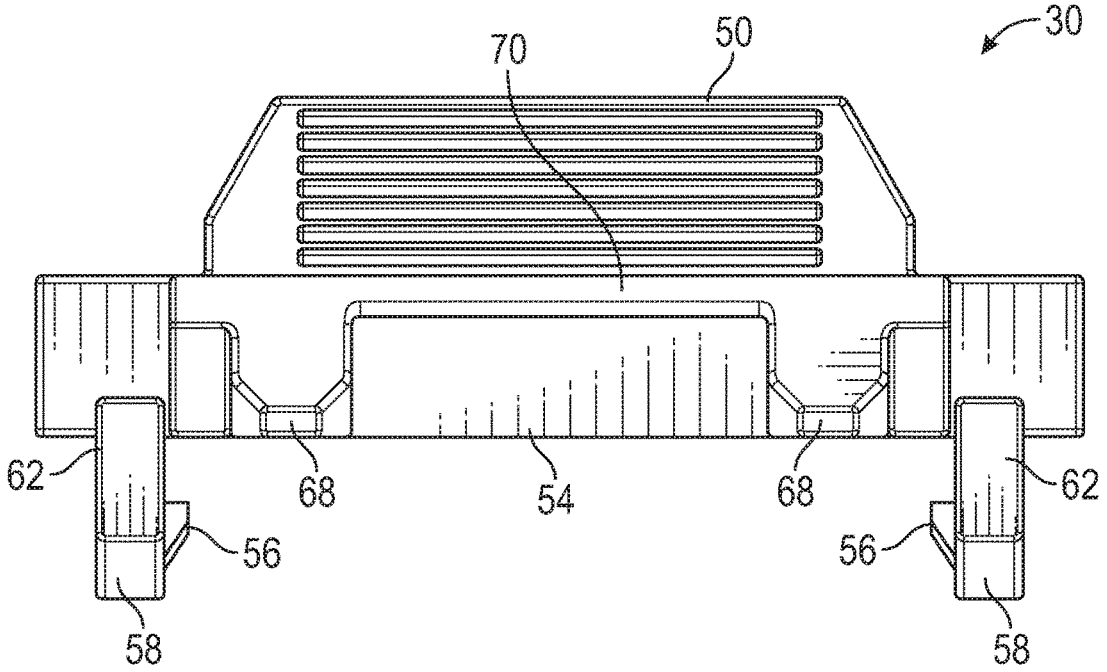
FIG. 6 is a front elevational view of the connector position assurance.

Referring to FIG. 4, there is illustrated a view similar to FIG. 3 with the connector position assurance 30 shown attached to the cover 16 in the pre-lock position. Referring to FIG. 5, there is illustrated an enlarged perspective view of the connector position assurance 30 while FIG. 6 is a front elevational view of the connector position assurance 30. The illustrated connector position assurance 30 is molded from plastic, but may be made of any desired material and by any desired process. The connector position assurance 30 includes a body 50. Two guides 52 extend from the body 50 on a mount side 54 of the body 50. The mount side 54 is the side of the connector position assurance 30 that faces the cover 16 when the connector position assurance 30 is attached thereto. When the connector position assurance 30 is attached to the connector position assurance mount 40, each of the guides 52 is located in one of the guide channels 42. Also, each guide 52 includes a catch 56 (visible in FIG. 6), and each of the catches 56 engages the cover 16 to retain the connector position assurance 30 on the connector position assurance mount 40.

The connector position assurance 30 also includes two lock arms 58 that extend from the mount side 54 of the body 50. Each of the lock arms 58 further extends in the assurance direction 48. When the connector position assurance 30 is attached to the connector position assurance mount 40, each lock arm 58 is located in one of the guide channels 42. Each lock arm 58 includes a lock tab 60 that extends from the lock arm 58 opposite the release direction 38. Each lock arm 58 also includes a release tab 62 that extends from the lock arm 58 opposite the release direction 38. As shown in FIG. 4, when the connector position assurance 30 is in the pre-lock position, each lock tab 60 engages the position assurance lock 44 in the respective guide channel 42 to prevent the lock tabs 60 from being moved in the assurance direction 48 relative to the connector position assurance mount 40. This prevents the connector position assurance 30 from being moved in the assurance direction 48 relative to the connector position assurance mount 40. Also, each of the release tabs 62 extends out of the respective guide channel 42 and is located in the handle seat 46.

Figure 7:
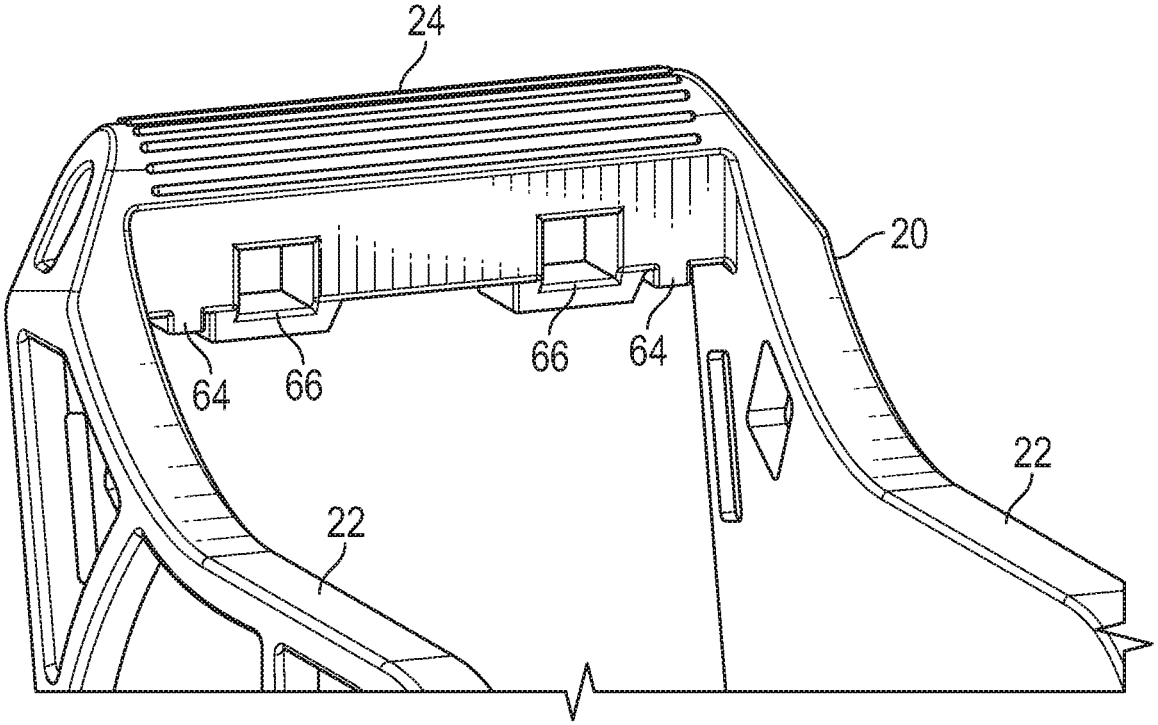
FIG. 7 is an enlarged perspective view of a portion of the assist lever.

Referring now to FIG. 7, there is illustrated a perspective view of a portion of the assist lever 20 showing the handle 24. As previously described, when the assist lever 20 is in the final position, a portion of the handle 24 is located in the handle seat 46. The handle 24 includes two projections 64 that will be located in the handle seat 46 when the assist lever 20 is in the final position. Also, the handle 24 includes two notches 66 that are oriented opposite the assurance direction 48 when the assist lever 20 is in the final position. The purpose of the projections 64 and the notches 66 will be described below.

Figure 8:
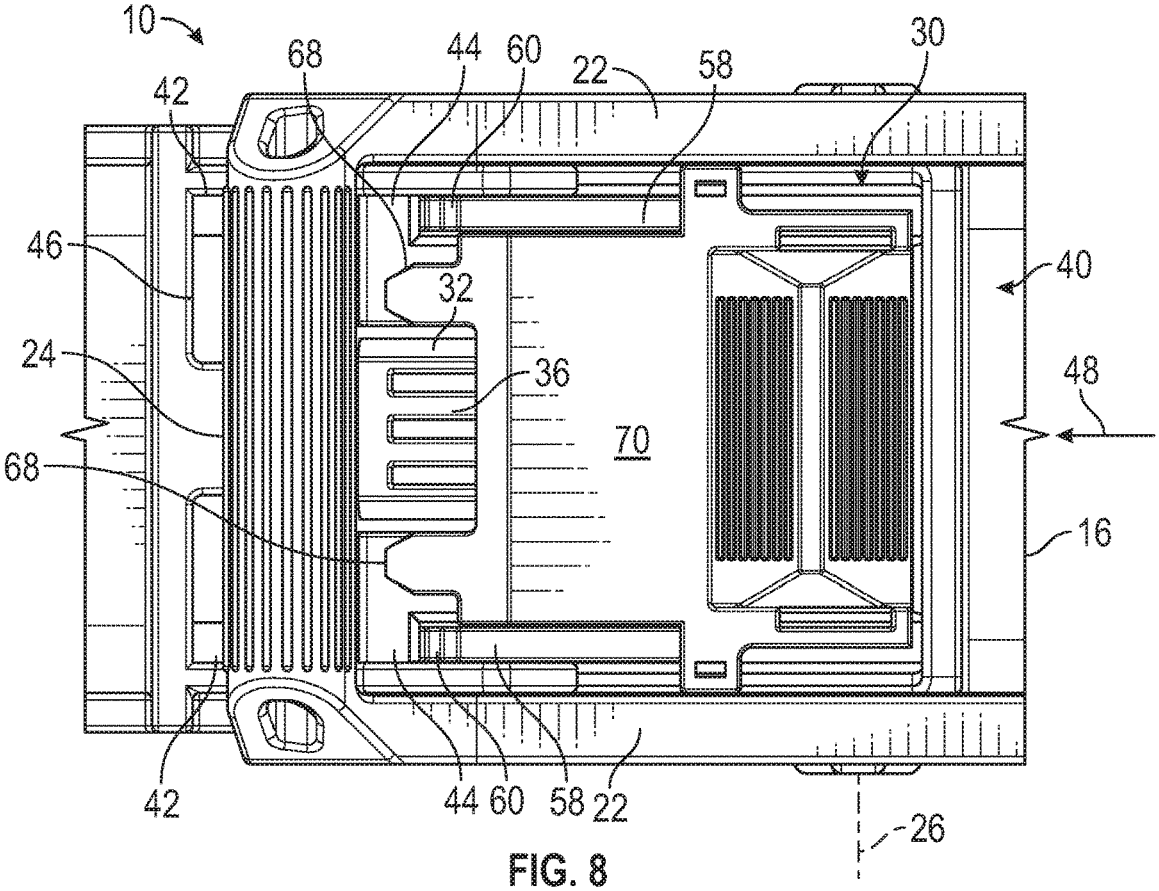
FIG. 8 is a view similar to FIG. 4 showing the assist lever in a final position.

Referring now to FIG. 8, there is illustrated a view similar to FIG. 4, with the assist lever 20 shown moved to the final position. Although not visible in FIG. 8, each of the projections 64 on the handle 24 engages one of the release tabs 62, and both of the release tabs 62 are pushed in the release direction 38 out of the handle seat 46. Each of the resilient lock arms 58 is also pushed in the release direction 38, which moves the lock tabs 60 in the release direction 38 so that the lock tabs 60 do not engage the position assurance locks 44. Alternatively, the assist lever 20 may engage any desired part of the connector position assurance 30 when the assist lever 20 is in the final position. For example, each of the projections 64 may engage one of locks tabs 60 to move the lock tabs 60 in the release direction 38. When the assist lever 20 is in the final position, the connector position assurance 30 may be moved in the assurance direction 48 relative to the connector position assurance mount 40.

Figure 9:
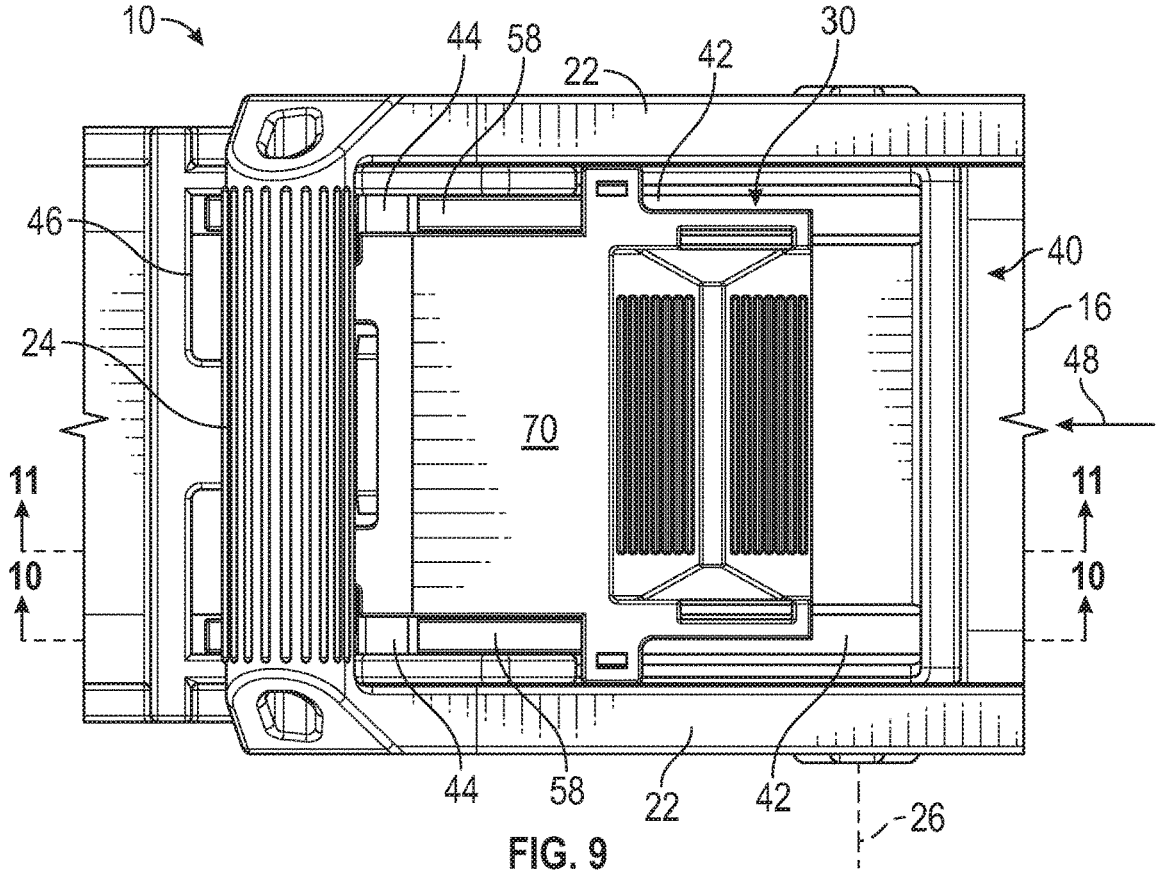
FIG. 9 is a view similar to FIG. 8 showing the connector position assurance in a lock position.
Figure 10:
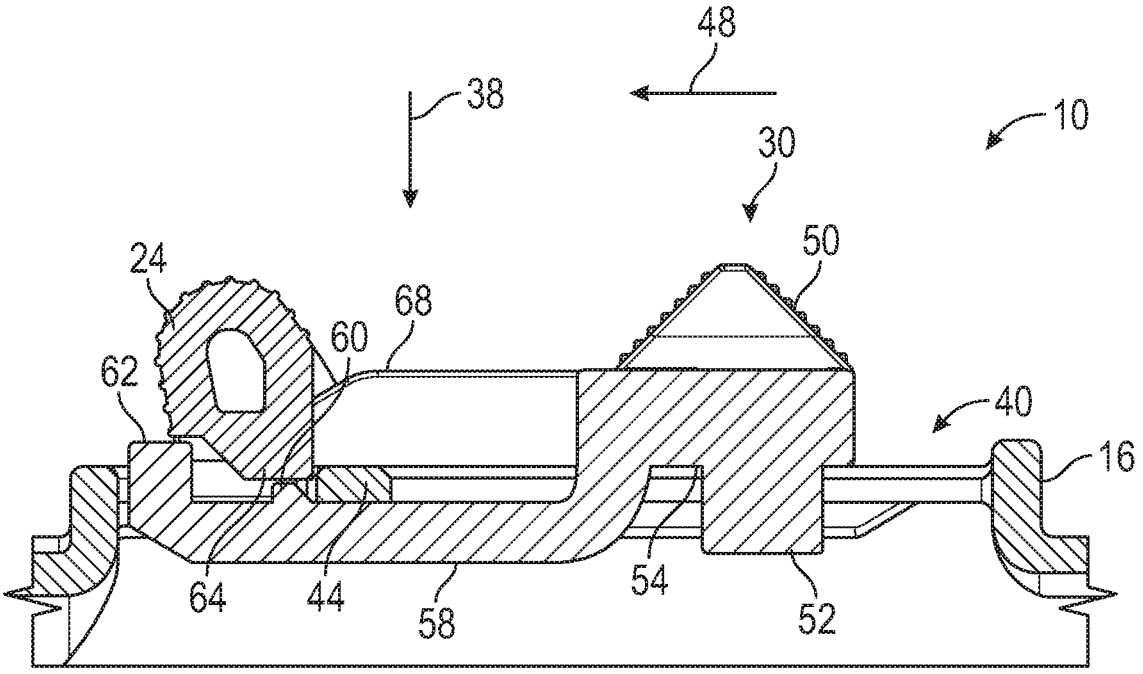
FIG. 10 is a cross-sectional view taken along line 10-10 of FIG. 9.

Referring now to FIG. 9, there is illustrated a view similar to FIG. 8 showing the connector position assurance 30 moved to the lock position. Referring to FIG. 10, there is illustrated a cross-sectional view taken along line 10-10 of FIG. 9 along one of the guide channels 42. As shown, when the connector position assurance 30 is in the lock position, the release tabs 62 are located in the assurance direction 48 of the projections 64, and the lock arms 58 are able to rebound opposite the release direction 38. This releases any stress on the lock arm 58. Additionally, the lock tabs 60 are located in the assurance direction 48 of the position assurance lock 44 and engage the position assurance lock 44 to prevent movement of the connector position assurance 30 opposite the assurance direction 48.

Figure 11:
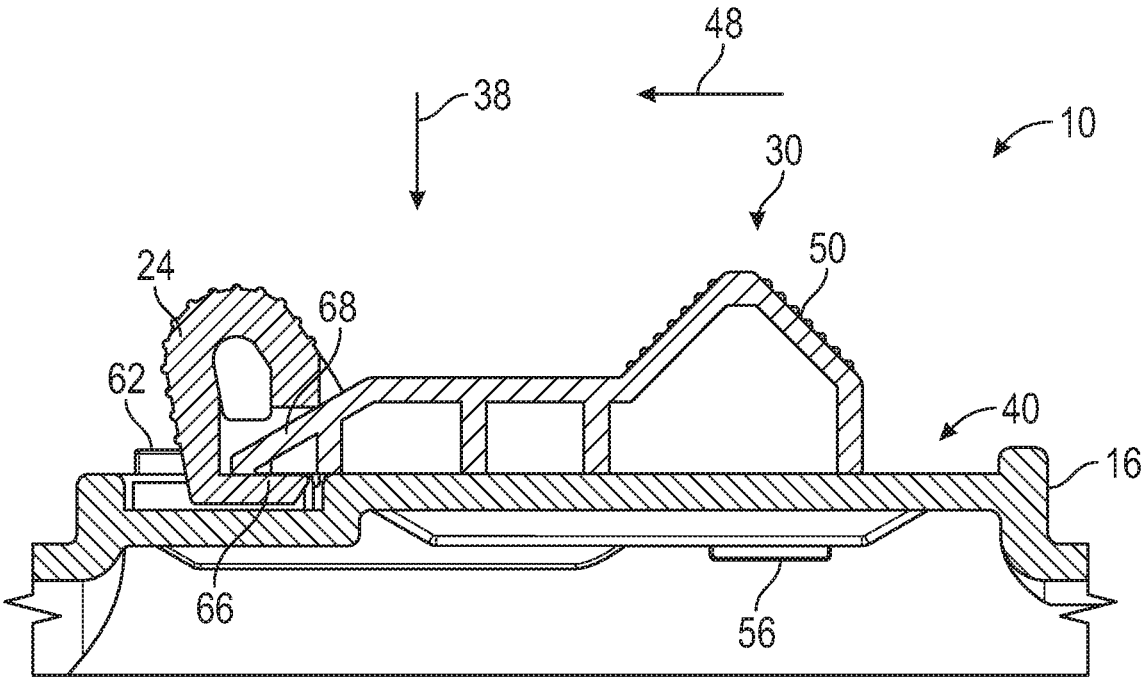
FIG. 11 is a cross-sectional view taken along line 11-11 of FIG. 9.

Referring to FIG. 11, there is illustrated a cross-sectional view taken along line 11-11 of FIG. 9 through one of the notches 66 on the handle 24. The connector position assurance 30 includes lever retainers 68 that extend from the body 50 in the assurance direction 48. As best shown in FIG. 8, the connector position assurance 30 includes two lever retainers 68. When the connector position assurance 30 is in the locked position, each lever retainer 68 is located in one of the notches 66 in the handle 24. Referring back to FIG. 11, the lever retainers 68 engage the handle 24 to prevent movement of the handle 24 relative to the connector position assurance mount 40. It should be appreciated that the connector position assurance 30 will prevent movement of the handle 24 and the assist lever 20 either in a direction toward the initial position or in an opposite direction.

Referring back to FIG. 9, the connector position assurance 30 also includes a latch shield 70. The illustrated latch shield 70 extends from the body 50 in the assurance direction 48 and extends between the two lever retainers 68. As shown in FIG. 9, when the connector position assurance 30 is in the lock position, the latch shield 70 is located opposite the release direction 38 of the press end 36 of the latch 32. Thus, the latch shield 70 prevents an operator from pressing the latch 32 when the connector position assurance 30 is in the lock position. Referring back to FIG. 2, when the connector position assurance 30 is in the lock position, the latch 32 is enclosed by the connector position assurance 30 in order to prevent actuation of the latch 32 to the opened position.

The electric connector assembly 10 may be removed from the header 12 by reversing the previously described process. The connector position assurance 30 is moved from the lock position (shown in FIG. 3 and FIG. 9) to the pre-lock position (shown in FIG. 8). This moves the latch shield 70 away from the latch 32. The latch 32 is then pressed, and the assist lever 20 is moved from the final position to the initial position, which will move the electric connector assembly 10 to the pre-mate position relative to the header 12.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electric connector assembly comprising:

a housing;

an assist lever attached to the housing for relative rotational movement and including one or more notches;

a latch that retains the assist lever in a final position relative to the housing; and a connector position assurance attached to the housing for relative movement between a pre-lock position and a lock position, wherein when the connector position assurance is in the lock position, the connector position assurance extends into the one or more notches in the assist lever and prevents rotation of the assist lever relative to the housing, and further wherein either:

the electrical connector assembly further includes a latch shield on the connector position assurance, wherein the latch is adapted to be moved in a release direction from a closed position to an opened position, and wherein when the connector position assurance is in the lock position, the latch shield is located opposite the release direction of the latch; or the connector position assurance further includes a body and two lever retainers that extend from the body, wherein the two lever retainers extend into respective notches in the assist lever when the connector position assurance is in the lock position.

2. The electric connector assembly of claim 1 further including a latch shield on the connector position assurance, wherein the latch is adapted to be moved in a release direction from a closed position to an opened position, and wherein when the connector position assurance is in the lock position, the latch shield is located opposite the release direction of the latch.

3. The electric connector assembly of claim 1, the connector position assurance further including a body and two lever retainers that extend from the body, wherein the two lever retainers extend into respective notches in the assist lever when the connector position assurance is in the lock position.

4. The electric connector assembly of claim 3 further including a latch shield on the connector position assurance that extends from the body, wherein the latch is adapted to be moved in a release direction from a closed position to an opened position, and wherein when the connector position assurance is in the lock position, the latch shield is located opposite the release direction of the latch.

5. The electric connector assembly of claim 3 further including a latch shield on the connector position assurance that extends between the two lever retainers, wherein the latch is adapted to be moved in a release direction from a closed position to an opened position, and wherein when the connector position assurance is in the lock position, the latch shield is located opposite the release direction of the latch.

6. The electric connector assembly of claim 3 further including a latch shield on the connector position assurance that extends from the body and between the two lever retainers, wherein the latch is adapted to be moved in a release direction from a closed position to an opened position, and wherein when the connector position assurance is in the lock position, the latch shield is located opposite the release direction of the latch.

7. An electric connector assembly comprising:

a housing including a catch;

an assist lever attached to the housing for movement relative thereto from an initial position to a final position and including a latch, wherein when the assist lever is in the final position, the latch engages the catch to retain the assist lever in the final position; and a connector position assurance attached to the housing for relative movement between a pre-lock position and a lock position and including a latch shield, wherein when connector position assurance is in the locked position:

(1) the connector position assurance engages the assist lever to retain the assist lever in the final position; and (2) the latch shield prevents the latch from being disengaged from the catch.

8. The electric connector assembly of claim 7 further including a latch shield on the connector position assurance, wherein the latch is adapted to be moved in a release direction from a closed position to an opened position, and wherein when the connector position assurance is in the lock position, the latch shield is located opposite the release direction of the latch.

9. The electric connector assembly of claim 7, the connector position assurance further including a body and two lever retainers that extend from the body, wherein the two lever retainers extend into respective notches in the assist lever when the connector position assurance is in the lock position.

10. The electric connector assembly of claim 9 further including a latch shield on the connector position assurance that extends from the body, wherein the latch is adapted to be moved in a release direction from a closed position to an opened position, and wherein when the connector position assurance is in the lock position, the latch shield is located opposite the release direction of the latch.

11. The electric connector assembly of claim 9 further including a latch shield on the connector position assurance that extends between the two lever retainers, wherein the latch is adapted to be moved in a release direction from a closed position to an opened position, and wherein when the connector position assurance is in the lock position, the latch shield is located opposite the release direction of the latch.

12. The electric connector assembly of claim 9 further including a latch shield on the connector position assurance that extends from the body and between the two lever retainers, wherein the latch is adapted to be moved in a release direction from a closed position to an opened position, and wherein when the connector position assurance is in the lock position, the latch shield is located opposite the release direction of the latch.

13. An electric connector assembly comprising:

a housing including a catch;

an assist lever attached to the housing for movement relative thereto from an initial position to a final position and including a latch and two notches, wherein when the assist lever is in the final position, the latch engages the catch to retain the assist lever in the final position; and a connector position assurance attached to the housing for relative movement between a pre-lock position and a lock position and including two lever retainers, wherein when connector position assurance is in the locked position, the two lever retainers cooperate with the two notches to retain the assist lever in the final position.

14. The electric connector assembly of claim 13 further including a latch shield on the connector position assurance, wherein the latch is adapted to be moved in a release direction from a closed position to an opened position, and wherein when the connector position assurance is in the lock position, the latch shield is located opposite the release direction of the latch.

15. The electric connector assembly of claim 13 further including a latch shield on the connector position assurance that extends from the body, wherein the latch is adapted to be moved in a release direction from a closed position to an opened position, and wherein when the connector position assurance is in the lock position, the latch shield is located opposite the release direction of the latch.

16. The electric connector assembly of claim 13 further including a latch shield on the connector position assurance that extends between the two lever retainers, wherein the latch is adapted to be moved in a release direction from a closed position to an opened position, and wherein when the connector position assurance is in the lock position, the latch shield is located opposite the release direction of the latch.

17. The electric connector assembly of claim 13 further including a latch shield on the connector position assurance that extends from the body and between the two lever retainers, wherein the latch is adapted to be moved in a release direction from a closed position to an opened position, and wherein when the connector position assurance is in the lock position, the latch shield is located opposite the release direction of the latch.

* * * * *